US005460131A

United States Patent [19]

Usko

[11] Patent Number: 5,460,131

[45] Date of Patent: Oct. 24, 1995

[54] COMPACT COMBINED LASH ADJUSTER AND RESET MECHANISM FOR COMPRESSION RELEASE ENGINE BRAKES

[75] Inventor: James N. Usko, North Granby, Conn.

[73] Assignee: Diesel Engine Retarders, Inc., Wilmington, Del.

[21] Appl. No.: 315,123

[22] Filed: Sep. 28, 1994

[51] Int. Cl.[6] ..... F02D 13/04

[52] U.S. Cl. ..... 123/321

[58] Field of Search ..... 123/321, 320, 123/322, 90.12, 90.15, 90.16

[56] References Cited

U.S. PATENT DOCUMENTS

| | | | |
|---|---|---|---|
| Re. 33,052 | 9/1989 | Meistrick et al. | 123/321 |
| 3,405,699 | 10/1968 | Laas | 123/97 |
| 4,398,510 | 8/1983 | Custer | 123/90.16 |
| 4,399,787 | 8/1983 | Cavanagh | 123/321 |
| 4,706,625 | 11/1987 | Meistrick et al. | 123/321 |
| 5,105,782 | 4/1992 | Meneely | 123/321 |
| 5,161,501 | 11/1992 | Hu | 123/324 |
| 5,186,141 | 2/1993 | Custer | 123/321 |
| 5,357,926 | 10/1994 | Hu | 123/321 |

*Primary Examiner*—Raymond A. Nelli
*Attorney, Agent, or Firm*—Fish & Neave; Robert R. Jackson

[57] ABSTRACT

In a compression release engine brake, each slave piston has an associated mechanism for both automatically adjusting the "lash" of the slave piston and for resetting the slave piston as soon as the slave piston has produced a compression release event and without needing to wait for the return stroke of the associated master piston. The mechanism preferably includes two nesting cups between an adjusting member and the slave piston. The inner cup is principally responsible for the lash adjusting function, while the outer cup is principally responsible for the slave piston resetting function.

4 Claims, 4 Drawing Sheets

VALVE LIFT
ENGINE CRANK ANGLE
TDC COMPRESSION
TDC EXHAUST
200
200a
200b
200c
210
210
A
B
D

VALVE LIFT
ENGINE CRANK ANGLE
TDC COMPRESSION
TDC EXHAUST
210
210
R
200e
200f
200g

COMPACT COMBINED LASH ADJUSTER AND RESET MECHANISM FOR COMPRESSION RELEASE ENGINE BRAKES

BACKGROUND OF THE INVENTION

This invention relates to compression release engine brakes, and more particularly to a compact mechanism for performing lash adjusting and slave piston reset functions in such brakes.

Compression release engine brakes are well known as shown, for example, by such references as Laas U.S. Pat. No. 3,405,699, Custer U.S. Pat. No. 4,398,510, Cavanagh U.S. Pat. No. 4,399,787, Hu U.S. Pat. No. 5,161,501, and Custer U.S. Pat. No. 5,186,141, all of which are hereby incorporated by reference herein. The two Custer patents mentioned above relate to mechanisms for automatically adjusting the "lash" of an engine brake when the brake is turned on or off. The lash is the cold-engine clearance between each slave piston in the engine brake and the engine component on which that slave piston acts when the engine brake is turned on. It is typically desirable to have this clearance be relatively large when the engine brake is off to ensure that the engine brake does not inadvertently hold open the exhaust valves of the engine, especially when the engine is hot and thermally expanded. On the other hand, it is typically desired to reduce this clearance when the engine brake is on so that optimal timing of exhaust valve openings produced by the engine brake is achieved. For this purpose the Custer patents show mechanisms for automatically moving the return stop of the slave piston when the engine brake is turned on. In general, these lash-adjusting mechanisms include a chamber which tends to enlarge (through the action of a spring) when the slave piston reciprocates away from the return stop. The chamber fills with hydraulic fluid, which is then substantially prevented from escaping (e.g., by the returned slave piston). The trapped fluid maintains the chamber in its enlarged size as long as the engine brake is on, thereby providing a new return stop position for the slave piston. When the engine brake is turned off, the hydraulic fluid gradually leaks out of this chamber, thereby allowing the slave piston to return to its original return stop position.

While the engine brake is on, the slave piston is typically reciprocated by hydraulic fluid flow from a master piston in the engine brake. The master piston derives its motion from a moving part of the engine such as a fuel injector push rod. Although the forward stroke of this engine part may have suitable characteristics for the desired slave piston forward stroke, the return stroke of this engine part often does not result in an acceptable return stroke of the slave piston. For example, the return stroke of the engine part may be so gradual and prolonged that the slave piston continues to hold open the associated exhaust valves through the normal exhaust stroke opening of those valves. Among the possible disadvantages of this are (1) sharp discontinuities in exhaust valve motion when the normal exhaust valve opening occurs, and (2) the risk of contact between the still-open exhaust valves and the associated engine piston near top dead center of the exhaust stroke.

To prevent the engine brake from opening the exhaust valves longer than necessary to produce the desired compression release events, the above-mentioned Cavanagh patent shows mechanisms for resetting the slave piston promptly after each compression release event and even though the associated master piston does not reset until substantially later. Such slave piston reset mechanisms typically operate by snapping open an aperture in the slave piston when the occurrence of a compression release event in the associated engine cylinder allows the pressure in the slave piston cylinder to drop below a certain value. Opening the slave piston aperture allows hydraulic fluid to escape from the slave piston cylinder, thereby allowing the slave piston return springs and other associated components to produce a return stroke of the slave piston, even though the master piston return stroke will not occur until later.

It is also known to "clip" the forward stroke of the slave piston (e.g., to prevent excessive travel of the associated engine exhaust valves which could cause them to contact the top of the engine piston at or near its top dead center position). Mechanisms for producing such slave piston clipping are shown, for example, in Laas U.S. Pat. No. 3,405,699 and Hu U.S. Pat. No. 5,161,501. These mechanisms typically include components for opening an aperture in the slave piston when the forward stroke of the slave piston has progressed to a predetermined point. This allows hydraulic fluid to bleed from the slave piston cylinder, thereby preventing the slave piston from moving forward beyond the point at which the aperture is opened. A typical clip valve mechanism does not have the snap-open action of a slave piston reset mechanism as in the above-mentioned Cavanagh patent. A clip valve mechanism therefore does not actually reset the slave piston like a reset mechanism does.

Both the automatic lash adjusting function (as in the Custer patents) and the slave piston resetting function (as in the Cavanagh patent) are sometimes needed. Devices which combine these functions are known as shown by Meistrick et al. U.S. Pat. No. 4,706,625, but it has been difficult to combine these functions in a compact, simple, and low cost way.

In view of the foregoing, it is an object of this invention to improve and simplify the provision of combined automatic lash adjusting and slave piston resetting mechanisms for compression release engine brakes.

It is another object of this invention to provide a relatively simple and compact mechanism which combines the functions of automatic lash adjustment and slave piston resetting for compression release engine brakes.

SUMMARY OF THE INVENTION

These and other objects of the invention are accomplished in accordance with the principles of the invention by providing a combined lash adjusting and reset mechanism for the slave piston in a compression release engine brake, which mechanism includes a pair of nesting cups. The inner cup (in cooperation with the outer cup and other elements of the mechanism) performs a lash adjusting function. The outer cup (in cooperation with a passageway in the slave piston and other elements of the mechanism) performs a slave piston resetting function. The inner cup has an aperture in its bottom (the term "bottom" and other similar terms being used herein in the sense of reference to a particular part of a cup shape rather than to any particular orientation of the cup in relation to gravity). The bottom of the inner cup is resiliently urged to move away from a fixed stop (e.g., the end of an adjusting screw which projects into the slave piston cylinder chamber) by a first spring which is not strong enough to overcome the force of the slave piston return springs. The bottom of the outer cup is resiliently urged toward contact with the bottom of the inner cup by a second spring. When the bottom of the outer cup is in contact with the bottom of the inner cup, the outer cup substantially seals the aperture in the bottom of the inner cup. The slave piston return springs resiliently urge the top of the slave piston against the outer surface of the bottom of the outer cup. When the bottom of the outer cup is in contact with the top of the slave piston, the outer cup substantially seals a passageway in the slave piston.

When the engine brake is turned on, high pressure hydraulic fluid is forced into the slave piston cylinder chamber whenever the associated engine exhaust valve is to produce a compression release event. This high pressure hydraulic fluid forces the slave piston to move down in the direction away from the above-mentioned adjusting screw. The outer cup initially moves down with the slave piston, thereby preventing the hydraulic fluid from escaping via the passageway in the slave piston. This downward motion of the outer cup allows hydraulic fluid to flow into the inner cup via the aperture in the bottom of the inner cup. When the compression release event has progressed to a predetermined point, the hydraulic fluid pressure in the slave piston cylinder chamber drops by an amount sufficient to allow the second spring to lift the outer cup off the top of the slave piston with a snap action, thereby allowing hydraulic fluid to escape from the slave piston cylinder chamber via the passageway in the slave piston. This allows the slave piston return springs (and other associated components) to produce a "reset" return stroke of the slave piston. This reset return stroke stops when the bottom of the outer cup reaches the bottom of the extended inner cup, thereby closing the aperture in the inner cup and trapping hydraulic fluid between the bottom of the inner cup and the end of the adjusting screw. The "lash" of the slave piston has thereby been automatically adjusted. This new lash setting is retained until the engine brake is turned off, after which the hydraulic fluid trapped in the inner cup gradually leaks away and the initial lash is restored.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
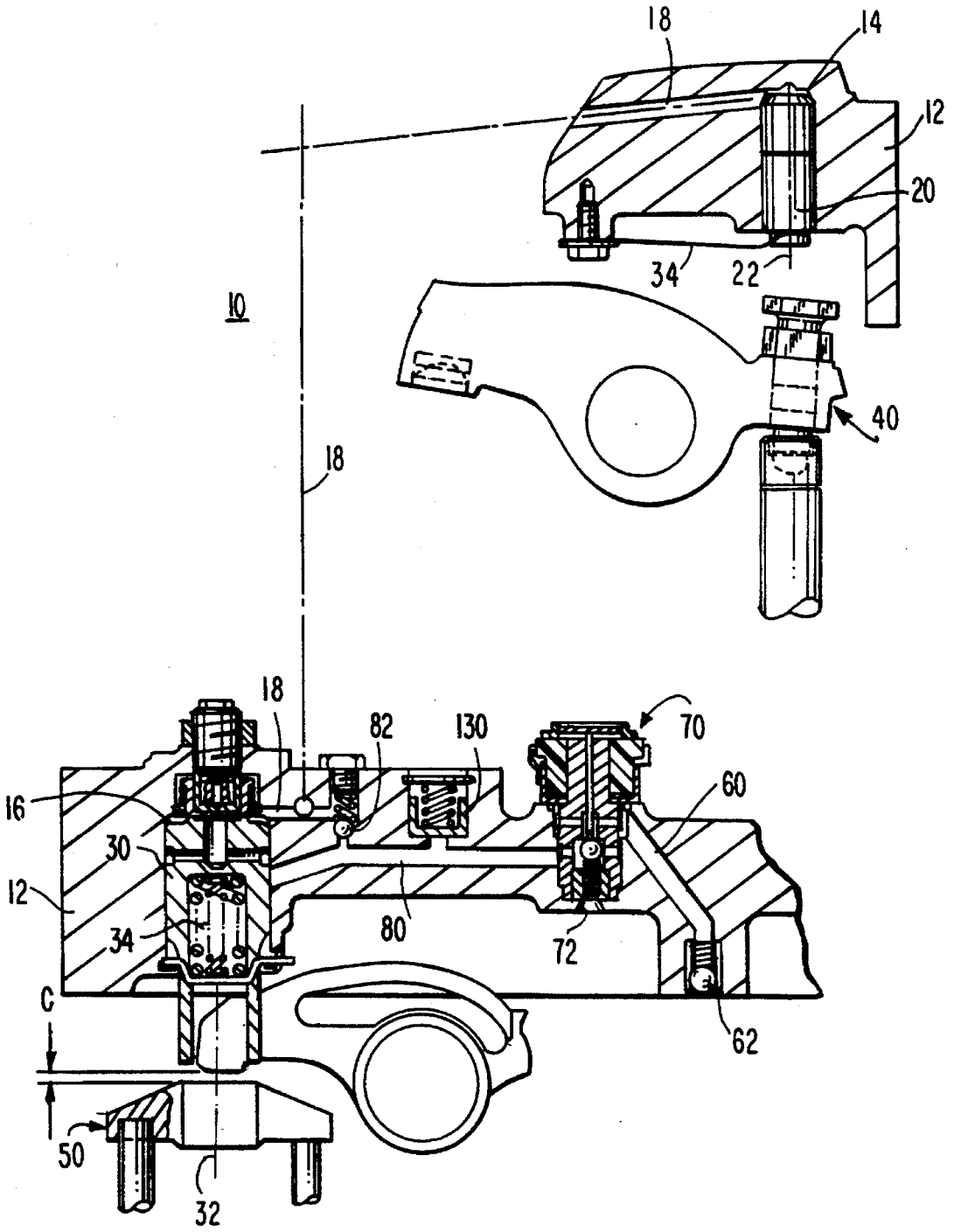
FIG. 1 is a simplified, partial, partly sectional view of illustrative compression release engine brake apparatus constructed in accordance with the principles of this invention. Portions of an associated internal combustion engine are also shown in FIG. 1.

As shown in FIG. 1 an illustrative compression release engine brake 10 constructed in accordance with this invention includes housing 12 having a master piston cylinder 14, a slave piston cylinder 16, and a hydraulic circuit 18 for hydraulically interconnecting those cylinders. FIG. 1 shows the engine brake off and includes only the components that are typically associated with one cylinder of an associated internal combustion engine.

Master piston 20 is disposed for reciprocation along axis 22 in master piston cylinder 14. Slave piston 30 is disposed for reciprocation along axis 32 in slave piston cylinder 16. When the engine brake is off, master piston 20 is held up out of contact with the fuel injector mechanism 40 of the associated internal combustion engine by leaf spring 34. Likewise, when the engine brake is off, slave piston 30 is held up out of contact with the exhaust valve mechanism 50 of the associated internal combustion engine by prestressed compression coil springs 34 (sometimes referred to herein as slave piston return springs 34).

Hydraulic fluid, which is typically engine lubricating oil, is supplied to engine brake 10 at a relatively low pressure from the associated engine via conduit 60. Check valve 62 prevents any hydraulic fluid from leaving the engine brake via conduit 60. Conventional solenoid valve 70 allows hydraulic fluid to drain from conduit 80 back into the associated engine via aperture 72 as long as the engine brake is off and solenoid valve 70 is accordingly not energized. On the other hand, when engine brake 10 is turned on and solenoid valve 70 is energized, solenoid valve 70 closes aperture 72 so that relatively low pressure hydraulic fluid from conduit 60 can pressurize conduit 80 and (via check valve 82) conduit 18 to a similar relatively low pressure. This relatively low pressure is sufficient to cause master piston 20 to extend from master cylinder 14 into contact with engine mechanism 40.

When master piston 20 is made to contact engine mechanism 40, subsequent upward movements of mechanism 40 cause master piston 20 to move upwardly along axis 22. Hydraulic fluid is prevented from flowing out of conduit 18 back into conduit 80 by check valve 82. The upward stroke of master piston 20 therefore produces a downward stroke of slave piston 30. This causes-slave piston 30 to push down engine exhaust valve mechanism 50, thereby opening the exhaust valves in the associated engine cylinder and producing a compression release engine braking event.

It should be noted that during each downward stroke of slave piston 30, the pressure of the hydraulic fluid in conduit 18 increases considerably, at least until the compression release event has occurred. This pressure increase is due at first to slave piston return spring 34, and then additionally and to a much greater degree to the associated engine exhaust valve return springs (not shown, but part of mechanism 50) and the gas pressure in the associated engine cylinder. On the other hand, during the same portion of the operating cycle of the depicted apparatus, the pressure of the hydraulic fluid in conduit 80 remains relatively low.

Figure 2:
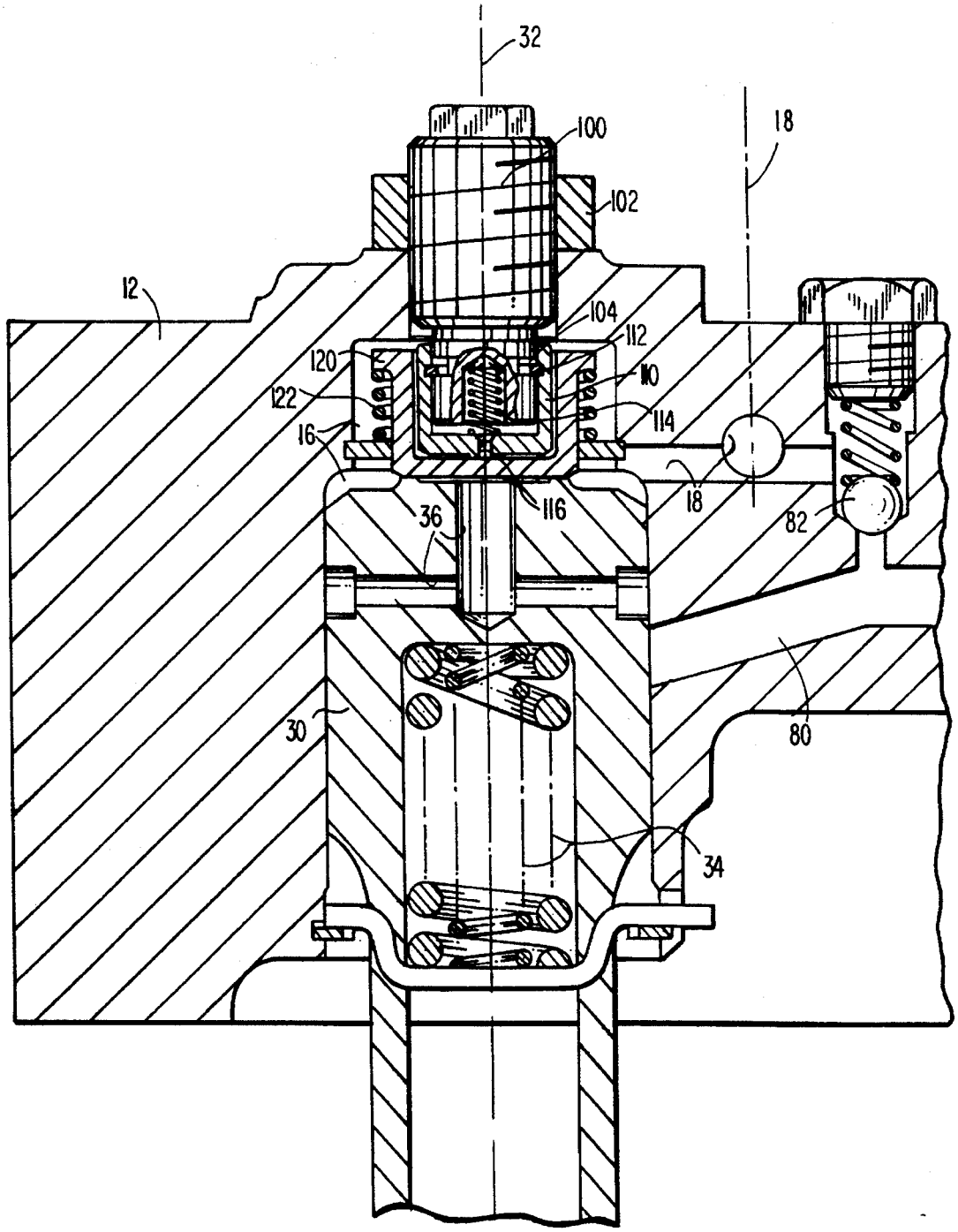
FIG. 2 is an enlargement of a portion of FIG. 1.

The detailed construction of slave piston 30 and the associated lash adjusting and slave piston reset mechanism is more clearly seen in FIG. 2. FIG. 2 shows the engine brake on but between high pressure pulses in conduit 18. Adjusting screw 100 is threaded into housing 12 so that its lower end extends into an upper portion of slave piston cylinder chamber 16. Adjusting screw 100 is locked in the desired position by tightening nut 102 down onto housing 12.

An inner cup member 110 is mounted on the lower end of adjusting screw 100. Inner cup 110 is capable of limited reciprocation relative to screw 100 along axis 32. The amount of this reciprocation is limited by snap ring 112 on the interior of the side wall of cup 110 in cooperation with a groove 104 in the adjacent side wall of adjusting screw 100. The fit between cup 110 and adjusting screw 100 is sufficiently close to substantially prevent hydraulic fluid from escaping from the interior of cup 110 via that fit. Prestressed compression coil spring 114 resiliently urges cup 110 to move down to its lowermost position as shown in FIG. 2, although the force of spring 114 is not sufficient to overcome the oppositely directed force of slave piston return springs 34. An aperture 116 is provided in the center of the bottom of cup 110.

Outer cup member 120 (sometimes referred to herein as a plunger member) fits loosely over the outside of inner cup 110 so that inner cup 110 nests inside outer cup 120. Outer cup 120 is resiliently urged upwardly along axis 32 by prestressed compression coil spring 122. In the position shown in FIG. 2 the inner surface of the bottom of cup 120 substantially seals aperture 116 in cup 110, and the opposite outer surface of the bottom of cup 120 seals the upper entrance to passageway 36 in slave piston 30.

It will be noted that a relatively large portion of the outer surface of the bottom of outer cup 120 is exposed to relatively low hydraulic pressure from passageway 36 as long as outer cup 120 is in contact with the top of slave piston 30. As a consequence, more of the upwardly facing (rather than downwardly facing) surface of outer cup 120 is exposed to the hydraulic fluid pressure in slave piston cylinder chamber 16 while outer cup 120 remains in contact with the top of slave piston 30. A high pressure pulse in the hydraulic fluid in chamber 16 therefore causes outer cup 120 to initially move down with slave piston 30, overcoming the oppositely directed force of spring 122. Outer cup 120 therefore keeps passageway 36 sealed during the initial portion of the downward stroke of slave piston 30. Note that the above-described downward motion of outer cup 120 is greater than the downward motion of inner cup 110 allowed by elements 104 and 112. Accordingly, aperture 116 is opened during each downward stroke of slave piston 30, thereby allowing the chamber formed between adjusting screw 100 and inner cup 110 to fill or be replenished with hydraulic fluid each time slave piston 30 moves down.

When the downward stroke of slave piston 30 has produced a compression release event in the associated engine cylinder, the pressure in that engine cylinder drops. This allows the hydraulic fluid pressure in chamber 16 to drop as well. When this happens, spring 122 is strong enough to lift outer cup 120 off the top of slave piston 30, thereby allowing hydraulic fluid to escape from chamber 16 via passageway 36 and conduit 80. An accumulator 130 in communication with conduit 80 accepts the volume of hydraulic fluid escaping from chamber 16 via passageway 36 so that this hydraulic fluid is more immediately available to refill master piston cylinder chamber 14 when mechanism 40 allows master piston 20 to perform its next return stroke.

As soon as outer cup 120 is lifted off the top of slave piston 30 and hydraulic fluid consequently begins to flow from chamber 16 via passageway 36, slave piston 30 begins its return stroke propelled by return springs 34 and also (at least initially) by the return springs of the exhaust valves. This return stroke stops when the top of slave piston 30 again contacts the bottom of outer cup 120 and the outer cup contacts the bottom of inner cup 110. Contact between the bottoms of cups 110 and 120 closes aperture 116, thereby trapping hydraulic fluid between elements 100 and 110. This trapped hydraulic fluid provides the automatic lash adjustment which prevents slave piston 30 from returning all the way to its engine-brake-off position. Instead, slave piston 30 is held out slightly between high pressure pulses from master piston 20 so that clearance C in FIG. 1 is thereby automatically adjusted to optimize the timing of compression release events in response to master piston pulses. When the engine brake is eventually turned off, the hydraulic fluid trapped between elements 100 and 110 gradually leaks away, thereby allowing return springs 34 to open up clearance C by pushing elements 30, 120, and 110 up against the lower end of adjusting screw 100.

Use of outer cup 120 to open passageway 36 in slave piston 30 as soon as the compression release event occurs allows the slave piston and the associated engine exhaust valves to begin their return strokes much earlier than they otherwise would because engine mechanism 40 typically does not allow master piston 20 to begin its return stroke until much later. This technique for resetting the slave piston effectively decouples the return stroke of the slave piston from the return stroke of the master piston. The timing and speed of the master piston return stroke may be dictated by considerations that are not readily harmonized with the desired slave piston return stroke. For example, the return stroke of mechanism 40 may be dictated by the requirements of a fuel injector fuel-filling stroke which may have to take place later and more gradually than is desirable for the associated slave piston return stroke. This principle is illustrated, for example, by FIGS. 3 and 4.

Figure 3:
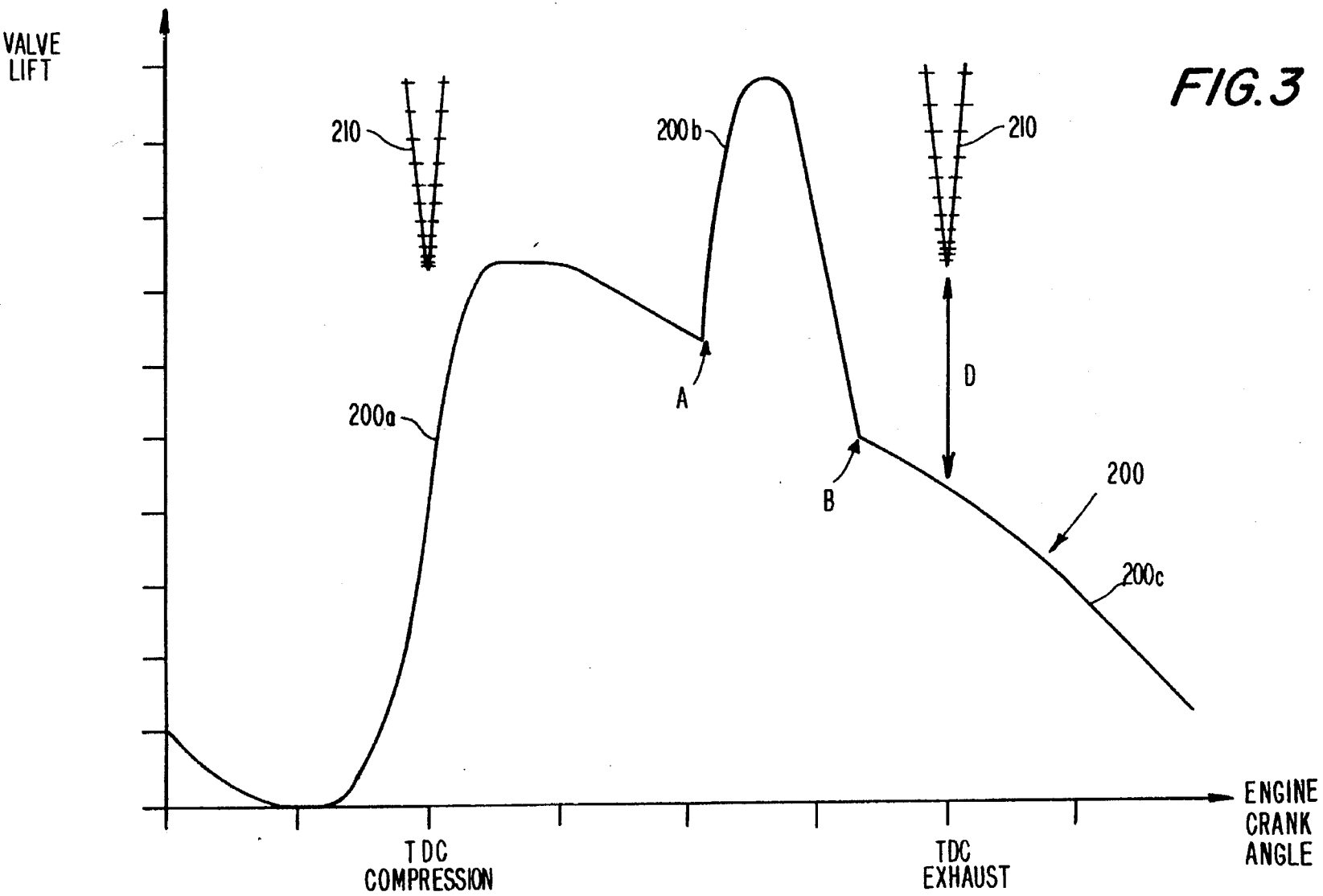
FIG. 3 is a simplified diagram of illustrative motion of various parts in an internal combustion engine during operation of an engine brake without all the features of the present invention.

FIG. 3 shows (by way of line 200) the motion of engine exhaust valves that might result during engine brake operation where the engine brake slave piston 30 is entirely under the control of master piston 20 (i.e., without the benefit of the slave piston resetting action of outer cup 120). Regions 200*a* and 200*c* are the portions of the exhaust valve opening curve produced by slave piston 30 in response to the motion of master piston 20. Region 200*b* is the portion of the exhaust valve opening curve produced by the normal exhaust valve opening mechanism of the engine. The return stroke of master piston 20 is so slow and prolonged that region 200*b* overlaps regions 200*a* and 200*c*. This can result in undesirably abrupt changes in exhaust valve motion (e.g., at discontinuities A and B). It can also increase the risk of contact between the exhaust valves and the top of the associated engine piston (whose motion is indicated by curves 210 in FIGS. 3 and 4) if clearance D becomes too small.

Figure 4:
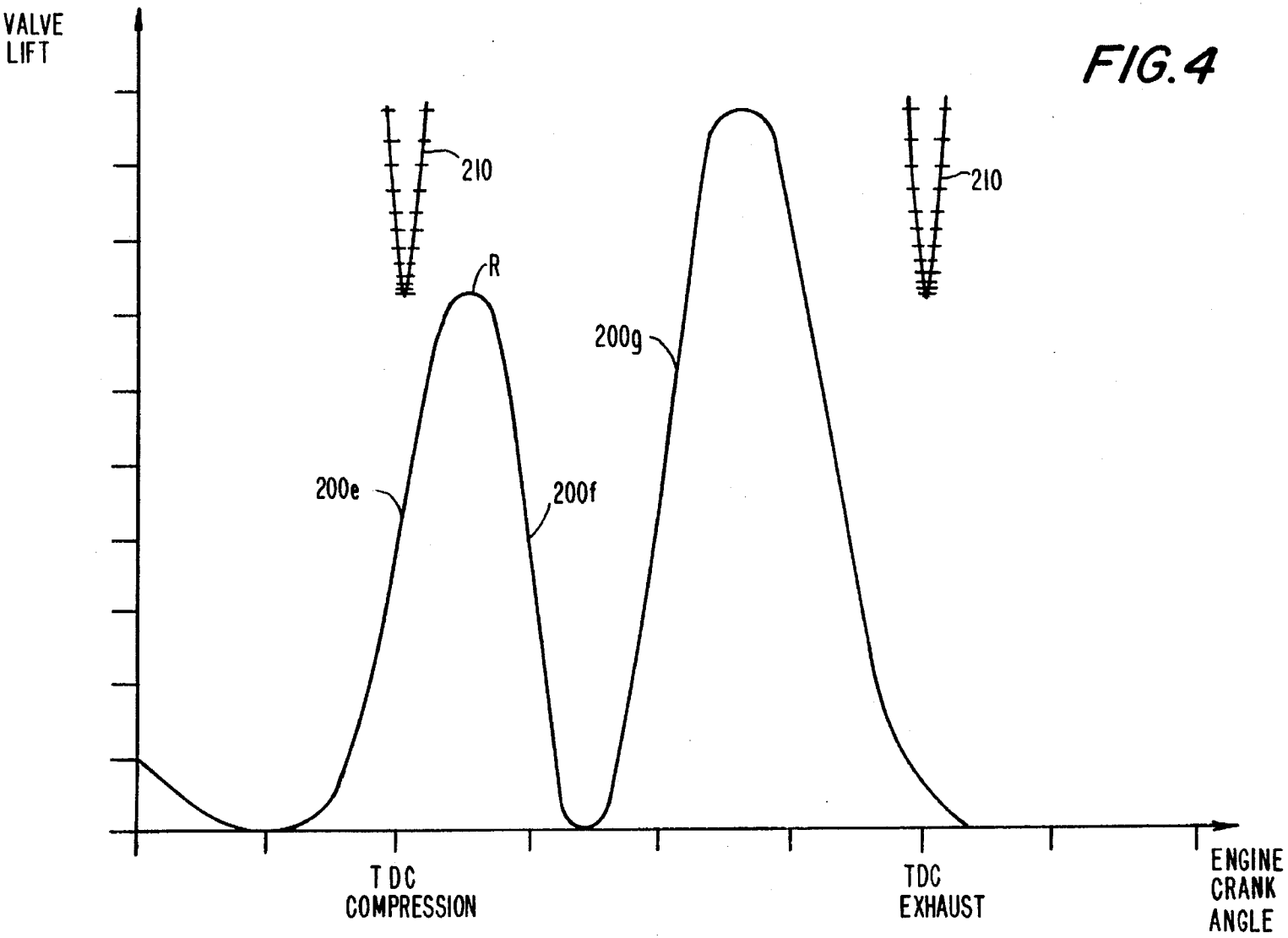
FIG. 4 is similar to FIG. 3 but for an engine with an engine brake in accordance with this invention.

FIG. 4 shows similar data but for an engine brake equipped with the slave piston resetting member 120. In region 200*e* the exhaust valves open in response to the forward strokes of master piston 20 and slave piston 30. This causes a compression release event near top dead center ("TDC") of the compression stroke. At point R outer cup 120 separates from slave piston 30 and the resetting return stroke 200*f* of the slave piston begins. Preferably, return stroke 200*f* is complete or nearly complete before the exhaust valves are opened again at 200*g* by the normal exhaust valve opening mechanism of the engine. Resetting the slave piston as described above therefore eliminates the risk of contact between the engine piston and the exhaust valves near top dead center of ("TDC") of the engine exhaust strokes. It also can eliminate or reduce overlap between exhaust valve openings produced by slave piston 30, on the one hand, and those produced by the normal exhaust valve opening mechanism of the engine, on the other hand. This helps reduce or eliminate undesirably abrupt discontinuities in the motion of the exhaust valves.

It will be noted that the hydraulic circuitry shown in FIG. 1 employs the invention which is the subject of commonly assigned, concurrently filed application Ser. No. 314,413 (Docket No. DP-111), which is hereby incorporated by reference herein. Thus, in accordance with that invention, valve 82 and hydraulic fluid accumulator 130 replace the more complex "control valve" previously used to perform such functions as filling the high pressure portion of the circuit when the engine brake is turned on, sealing that portion of the circuit during operation of the engine brake, and draining that portion of the circuit when the engine brake is turned off. However, if for any reason it is preferred to use the present invention with a traditional control valve (e.g., of the type included in FIG. 1 of the above-mentioned application), that is certainly a possible alternative embodiment of this invention.

It will be understood that the foregoing is only illustrative of the principles of this invention, and that various modifications can be made by those skilled in the art without departing from the scope and spirit of the invention. For example, the motion of the master piston in the engine brake can be produced by engine components other than a fuel injector mechanism.

The invention claimed is:

1. Apparatus for releasing hydraulic fluid from a slave piston cylinder in a compression release engine brake when the hydraulic pressure in the cylinder falls below a predetermined threshold value comprising:

an adjusting member having a portion which projects into the cylinder parallel to the axis along which a slave piston in the cylinder reciprocates;

a cup member mounted on the portion of said adjusting member which projects into the cylinder, said portion being at least partly received in said cup member, and said cup member being reciprocable relative to said portion by a limited amount parallel to said axis;

a cup-shaped plunger member telescopically fitted over said cup member for reciprocation relative to said cup member parallel to said axis, said cup member having an aperture which is substantially sealed by said plunger member when said plunger member is reciprocated against said cup member, and said plunger member having an outer surface transverse to said axis for sealing an aperture in said slave piston when said plunger member is pressed against said slave piston, said aperture in said slave piston being the entrance to a conduit through which hydraulic fluid can escape from said cylinder;

a first spring for resiliently urging said cup member to reciprocate away from said portion;

a second spring for resiliently urging said plunger member to reciprocate toward said cup member, said plunger member having a net surface area transverse to said axis and facing away from said slave piston which is exposed to hydraulic fluid in said cylinder, said net surface area being large enough so that when the hydraulic fluid pressure in said cylinder is greater than said threshold value, the hydraulic force on said net surface area overcomes the force of said second spring and causes said plunger member to reciprocate with said slave piston, but when said hydraulic fluid pressure falls below said predetermined threshold value, said second spring urges said plunger member to reciprocate away from said slave piston, thereby opening said aperture in said slave piston and allowing hydraulic fluid to escape from said cylinder.

2. The apparatus defined in claim 1 wherein when said plunger member reciprocates away from said cup member, said first spring urges said cup member to reciprocate away from said portion to create a chamber between said cup member and an adjacent end surface of said portion which is transverse to said axis, said plunger member allowing hydraulic fluid from said cylinder to flow through said aperture in said cup member to fill said chamber.

3. The apparatus defined in claim 2 wherein, except for said aperture in said cup member, said chamber is substantially sealed by said portion and said cup member.

4. The apparatus defined in claim 1 wherein hydraulic fluid which escapes from said cylinder via said aperture in said slave piston flows into a hydraulic circuit maintained at a relatively low pressure which is substantially below said threshold value, and wherein said circuit comprises:

accumulator means for temporarily receiving a volume of hydraulic fluid substantially equal to the volume of hydraulic fluid which escapes from said cylinder via said aperture in said slave piston; and check valve means between said circuit and a hydraulic fluid conduit by which hydraulic fluid is supplied to said cylinder at pressures above said relatively low pressure, said check valve substantially preventing hydraulic fluid from flowing from said conduit to said circuit.

* * * * *